US006480697B2

(12) United States Patent
Kojima

(10) Patent No.: US 6,480,697 B2
(45) Date of Patent: Nov. 12, 2002

(54) IMAGE-FORMING APPARATUS, NETWORK-TYPE IMAGE-FORMING APPARATUS, AND METHOD THEREFOR

(75) Inventor: Takeshi Kojima, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/779,568

(22) Filed: Feb. 9, 2001

(65) Prior Publication Data

US 2002/0048475 A1 Apr. 25, 2002

(30) Foreign Application Priority Data

Sep. 19, 2000 (JP) ..... 2000-283463

(51) Int. Cl.[7] ..... G03G 15/00; B65H 29/00
(52) U.S. Cl. ..... 399/404; 271/184
(58) Field of Search ..... 399/82, 85, 404, 399/405; 271/184, 185; 270/52.03

(56) References Cited

U.S. PATENT DOCUMENTS 4,635,920 A * 1/1987 Kodama ..... 271/184 X
4,866,487 A * 9/1989 Ohuchi et al. ..... 399/404
5,427,367 A * 6/1995 Kimura et al. ..... 271/185
5,512,996 A * 4/1996 Fare ..... 399/404
5,848,346 A * 12/1998 Takashiro ..... 399/404

FOREIGN PATENT DOCUMENTS

JP 02-023153 * 1/1990
JP 11-217153 8/1999

* cited by examiner

*Primary Examiner*—Sandra Brase
(74) *Attorney, Agent, or Firm*—Armstrong, Westerman & Hattori, LLP

(57) ABSTRACT

In an image-forming apparatus, which discharges to a stacker a sheet on which an image has been formed, the sorting of printed matter is performed on the stacker without providing optional equipment. Because of being constituted so as to independently drive a plurality of discharging rollers (30, 31), which discharge a sheet (100) to a stacker (19), and such that a controller (50) differs the driving of this plurality of discharging rollers for a normal mode and an attitude control mode, sorting of printed matter can be performed on top of the stacker with a single paper feeding means and a single stacker without providing optional equipment. Further, because the driving of the discharging roller of the one side is stopped for a predetermined period of time during attitude control, and a sheet is rotated using the roller thereof as a pivot point, it becomes possible to perform stacking easily and stably even for multiple types of media for which the stacking angle was unstable with a method, whereby paper discharging is performed by differentiating the speed of the right and left rollers.

10 Claims, 13 Drawing Sheets

IMAGE-FORMING APPARATUS, NETWORK-TYPE IMAGE-FORMING APPARATUS, AND METHOD THEREFOR

BACKGROUND OF THE INVENTION

1. Field of the Invention

The present invention relates to an image-forming apparatus, a network-type image-forming apparatus and method therefor for discharging to a stacker a sheet on which an image has been formed by an image-forming unit, and more particularly, to an image-forming apparatus, a network-type image-forming apparatus and method therefor for controlling the attitude of a discharged sheet in a stacker.

2. Description of the Related Art

A page printer, such as an electro-photographic printer, is capable of high-speed printing, and is being used widely as a computer output device. In line with the promotion of networking of information processing equipment in recent years, often a single printer, such as an electro-photographic printer, is connected to a plurality of personal computers (PCs) being no exception to this rule. Further, in accordance with the faster processing capabilities of printers, instead of printing by copying machine a required number of copies of a printed sheet that was printed on a printer, utilization environments in which a required number of copies is printed by printer are on the increase.

Consequently, there is need for a contrivance for using a printer either in an environment, wherein a plurality of number of copies are printed at one time, or in an environment, wherein a single printer is used by a plurality of users.

With a conventional printer, after printing, the paper thereof is stacked straight. Therefore, when a plurality of users successively use a printer, or a plurality of number of copies are printed, the printed matter, which should be sorted, is piled one on top of the other.

Because it is not possible to change the attitude of a sheet with a single stacker like this, the following methods are known as methods for sorting by user and by number of copies.

(1) A multi-bin unit or plurality of stackers is provided either separately from or integrated with a printer, and sorting is performed by changing the storage location of the discharged sheets in the unit or the stacker.

(2) A post-sheet-processing device is disposed on a copying machine, and sorting is performed by controlling the attitude of discharged sheets of paper via the post-processing device (For example, Japanese Patent Laid-open No. H11-217153).

(3) When the same is done using a printer that does not have a multi-bin or plurality of stackers, two or more paper feeding cassettes (units) are provided, the same medium is set longitudinally and transversely, respectively, the cassettes are switched for each job, and sheets of paper are stacked alternately longitudinally and transversely.

However, the problem with these methods is that options, such as a multi-bin, post-processing device, or second cassette must be added, increasing device volume and running counter to efforts to make devices smaller.

Further, the problem is that optional products, unlike general-purpose mass-produced printers, are not produced in volume, thus increasing implementation costs.

SUMMARY OF THE INVENTION

Therefore, it is an object of the present invention to provide an image-forming apparatus, network-type image-forming apparatus and method therefor for controlling inside an image-forming apparatus the attitude of a sheet for sorting, and for preventing a device from becoming large.

Further, it is another object of the present invention to provide an image-forming apparatus, network-type image-forming apparatus and method therefor for controlling the attitude of a discharged sheet without providing option devices, and for lowering implementation costs.

To achieve these objects, an image-forming apparatus and a network-type image-forming apparatus of the present invention comprise; an image-forming unit for forming an image on a sheet, a stacker for storing a sheet on which an image has been formed, a discharging unit for discharging to the above-mentioned stacker via a plurality of independently driven discharging rollers a sheet on which an image has been formed by an image-forming unit, and a controller for controlling the driving of the above-mentioned discharging rollers. The controller selectively executes an attitude control mode, whereby the driving of the discharging rollers of the one side of the above-mentioned plurality of discharging rollers is stopped for a predetermined period of time part way through the discharging of the above-mentioned sheet by the above-mentioned plurality of discharging rollers, and thereafter, the driving of the above-mentioned discharging rollers of the one side is restarted, and a normal mode, whereby the above-mentioned sheet is discharged by driving both sides of the above-mentioned plurality of discharging rollers.

An image-forming method of the present invention comprises the steps of image-forming for forming an image on a sheet, discharging for discharging to a stacker via an independently-driven plurality of discharging rollers a sheet on which an image has been formed by the above-mentioned image-forming unit, and controlling for controlling the driving of the above-mentioned discharging rollers. The controlling step selectively executes an attitude control mode, whereby the driving of the discharging rollers of the one side of the above-mentioned plurality of discharging rollers is stopped for a predetermined period of time part way through the discharging of the above-mentioned sheet by the above-mentioned plurality of discharging rollers, and thereafter, the driving of the above-mentioned discharging rollers of the one side is restarted, and a normal mode, whereby the above-mentioned sheet is discharged by driving both sides of the above-mentioned plurality of discharging rollers.

Because the present invention is constituted so as to independently drive a plurality of discharging rollers, which discharge a sheet to a stacker, and such that the driving of this plurality of discharging rollers differs for a normal mode and an attitude control mode, it is possible to sort printed matter on top of a stacker with one paper feeding means and a single stacker without providing optional equipment. Further, because the driving of the discharging rollers of the one side is stopped for a predetermined period of time during attitude control, and a sheet is rotated using this roller as a pivot point, it becomes possible to perform stacking easily and stably even for multiple types of media for which the stacking angle was unstable with a method, whereby paper discharging is performed by differing the speed of the right and left rollers.

Further, in the present invention, in forming an image on the above-mentioned sheet for a plurality of numbers of copies, preferably the controller alternately switches the discharge control of the above-mentioned sheet of each of the above-mentioned numbers of copies between the above-mentioned attitude control mode and the above-mentioned normal mode for each of the above-mentioned numbers of copies to sort the image-formed printed matter on the stacker. Therefore, it is possible to achieve on a stacker the sorting of a plurality of numbers of copies of printed matter.

Furthermore, in the present invention, in forming an image on the above-mentioned sheet for a plurality of jobs, preferably the controller alternately switches the discharge control of the above-mentioned sheet of each of the above-mentioned jobs between the above-mentioned attitude control mode and the above-mentioned normal mode for each of the above-mentioned jobs to sort the above-mentioned image-formed printed matter on the above-mentioned stacker. Therefore, it is possible to achieve on a stacker the sorting of printed matter by job.

DESCRIPTION OF THE PREFERRED EMBODIMENTS

The preferred embodiments of the present invention will be explained below in the order of image-forming apparatus, sorting control, network printer, and other aspects of the embodiment using an electro-photographic printer as an example.

[Image-forming Apparatus]

Figure 1:
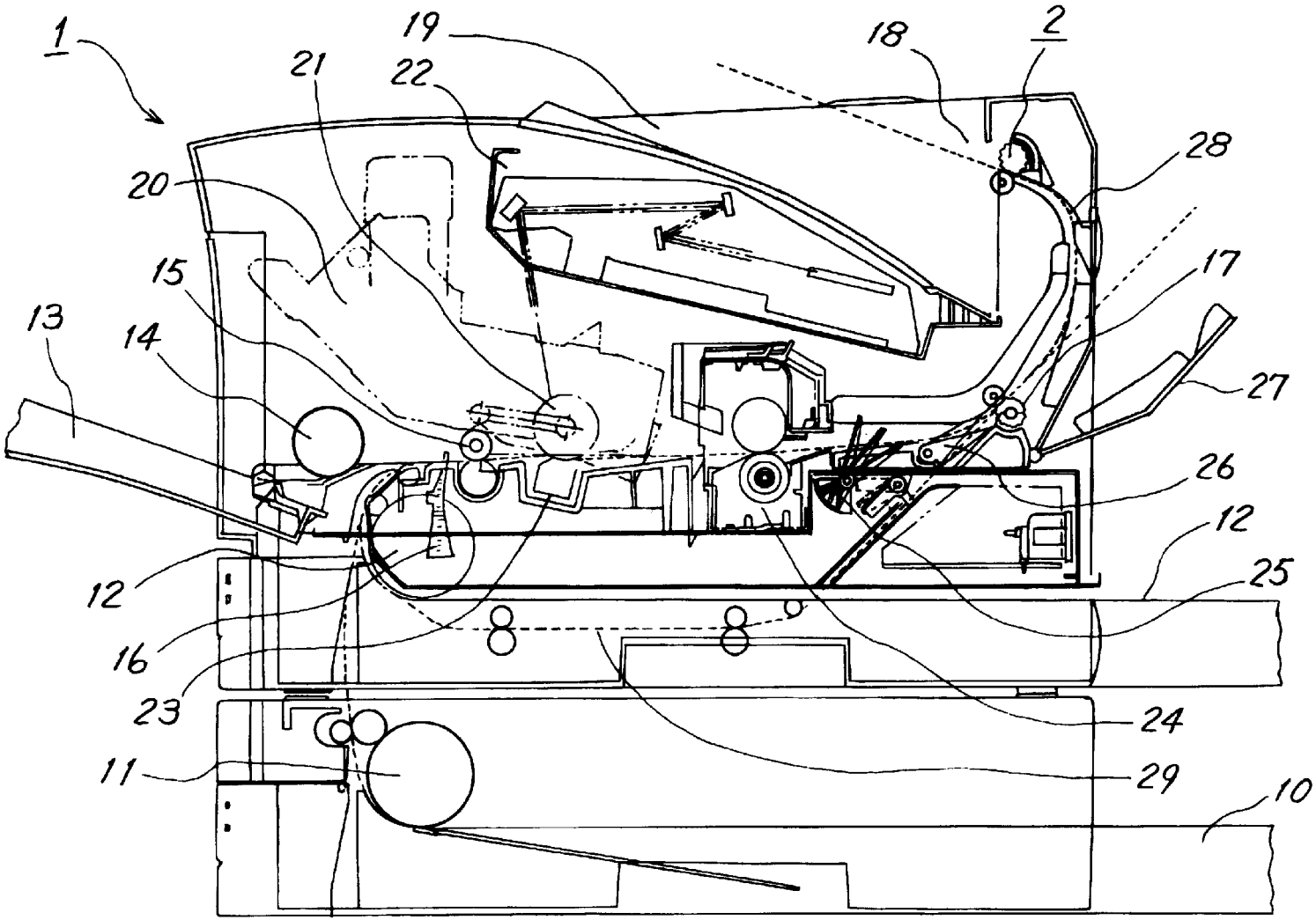
FIG. 1 is a block diagram of an image-forming apparatus of a first aspect of the embodiment of the present invention.
Figure 2:
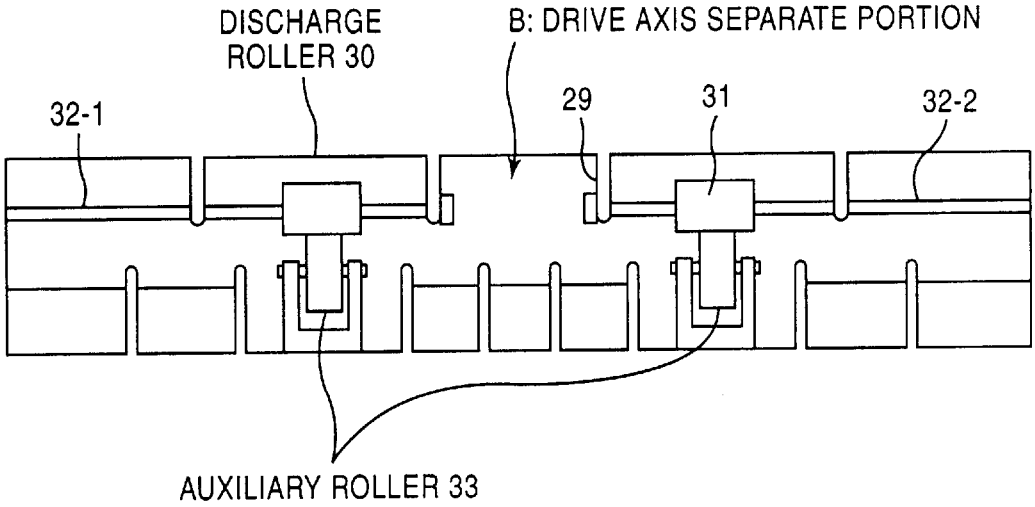
FIG. 2 is a block diagram of paper-discharging rollers of the image-forming apparatus in FIG. 1.
Figure 3:
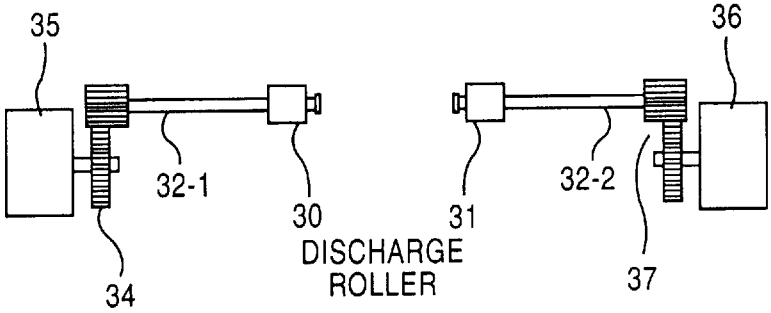
FIG. 3 is a schematic diagram of one example of a drive constitution of FIG. 2.
Figure 4:
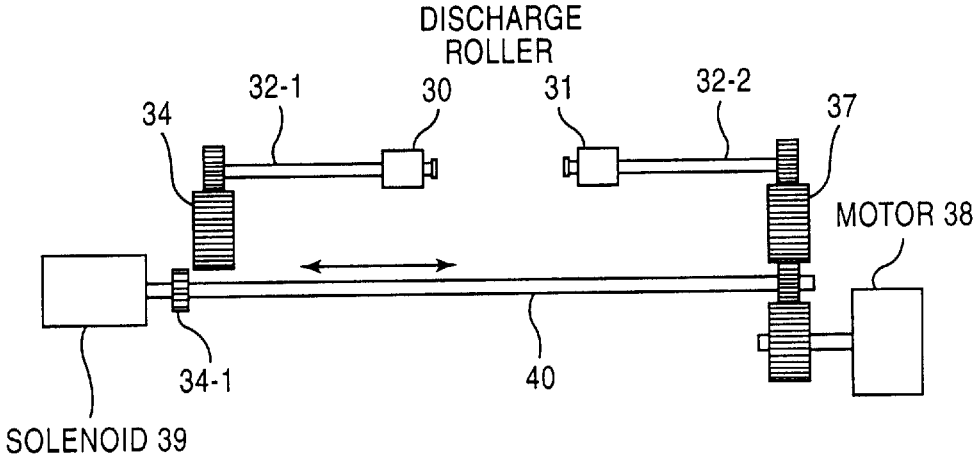
FIG. 4 is a schematic diagram of another example of a drive constitution of FIG. 2.
Figure 5:
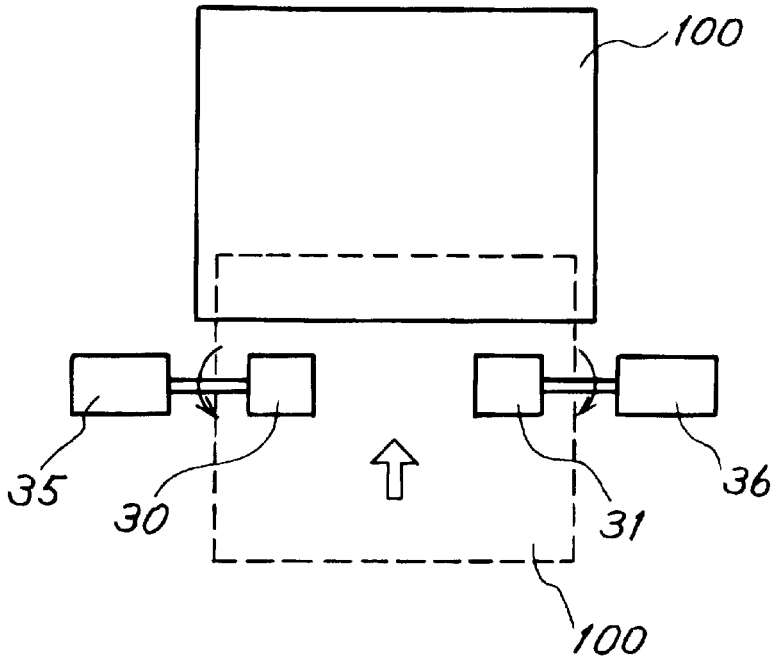
FIG. 5 is a schematic diagram of the normal discharging mode of the paper-discharging portion of FIG. 2.
Figure 6:
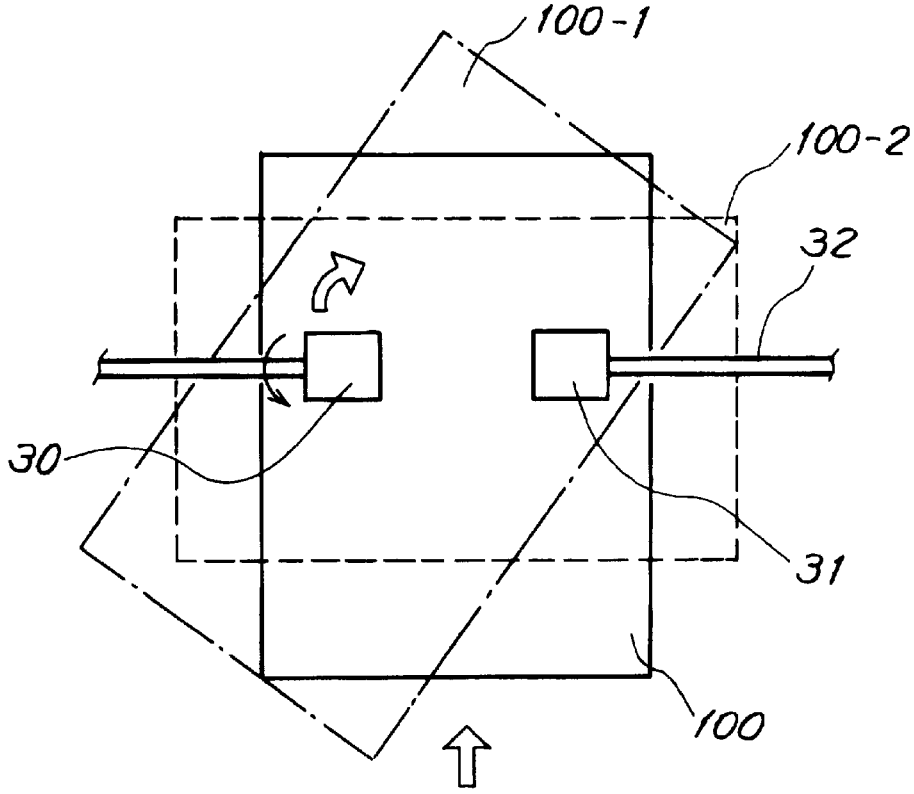
FIG. 6 is a schematic diagram of the attitude control paper-discharging mode of the paper-discharging portion of FIG. 2.
Figure 7:
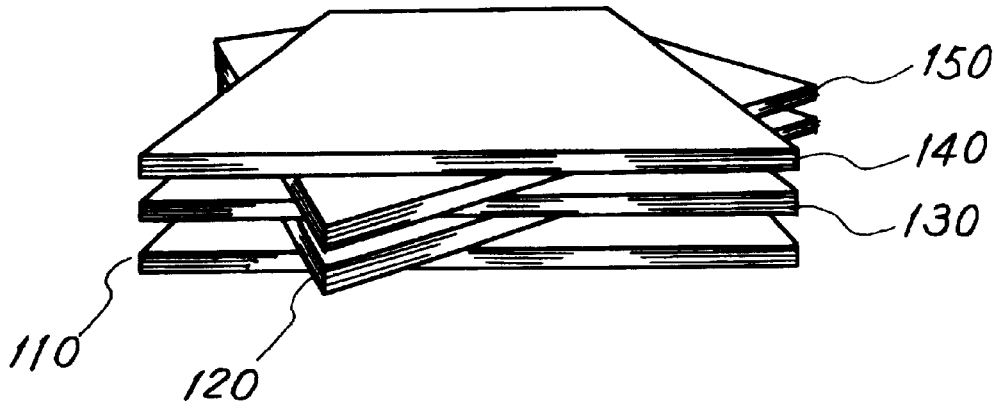
FIG. 7 is a schematic diagram of one example of a stack according to the paper-discharging portion of FIG. 2.
Figure 8:
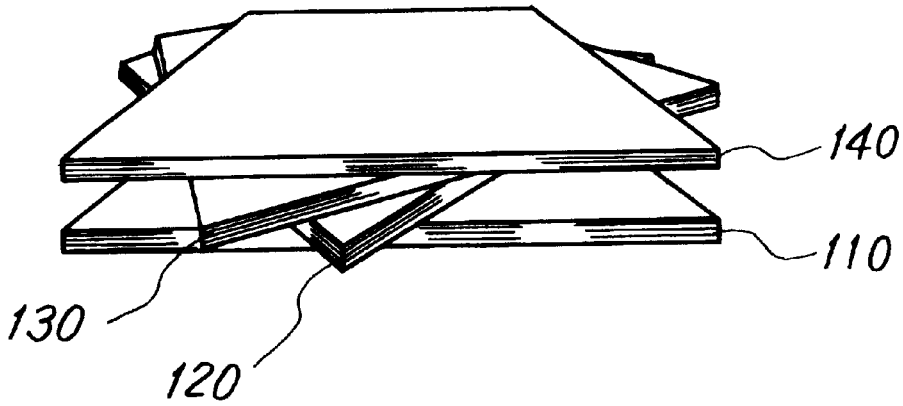
FIG. 8 is a schematic diagram of another example of a stack according to the paper-discharging portion of FIG. 2.
Figure 9:
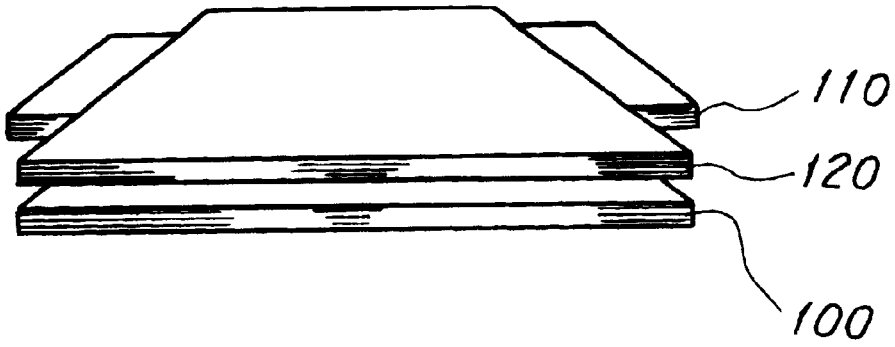
FIG. 9 is a schematic diagram of another example of a stack according to the paper-discharging portion of FIG. 2.
Figure 10:
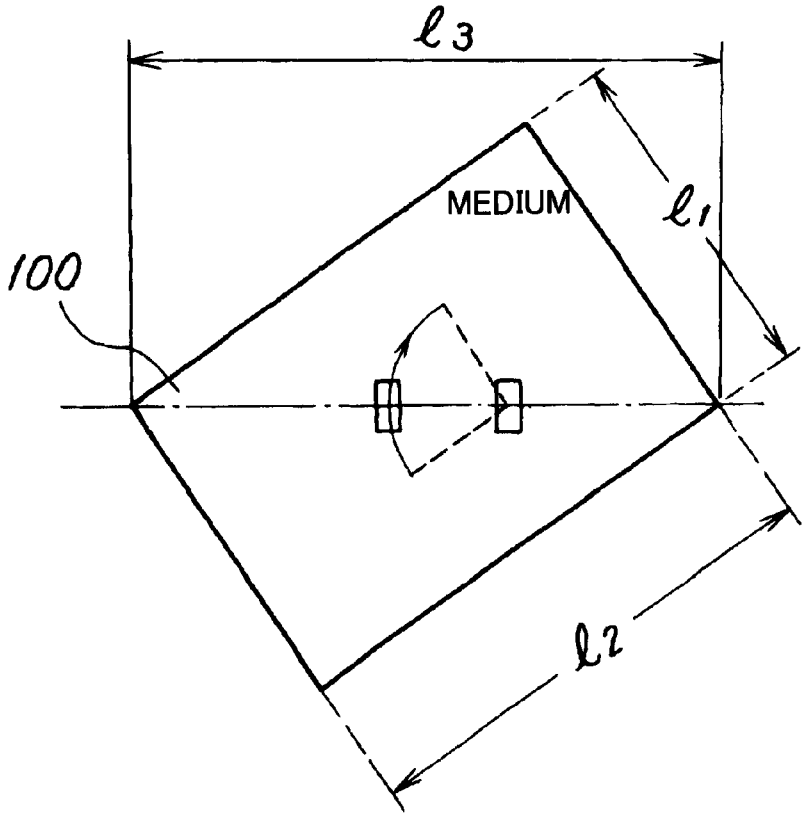
FIG. 10 is a schematic diagram of the width of the paper discharge opening of the paper-discharging portion of FIG. 2.

FIG. 1 is a block diagram of an image-forming apparatus of a first aspect of the embodiment of the present invention, FIG. 2 is a block diagram of the paper-discharging rollers of the image-forming device of FIG. 1, FIG. 3 and FIG. 4 are block diagrams of the driving mechanisms of the paper-discharging rollers, FIG. 5 and FIG. 6 are schematic diagrams of a paper-discharging operation, FIG. 7 through FIG. 9 are schematic diagrams of stacked states resulting from paper-discharging operations, and FIG. 10 is a schematic diagram of the width of a paper discharge opening.

The image-forming apparatus 1 shown in FIG. 1 is an electro-photographic printer, and is a small-size printer with a small footprint. The printer 1 is equipped with an electro-photographic process cartridge 20 having a photosensitive drum 21. This process cartridge 20 is a replaceable component of the printer apparatus 1. The process cartridge 20, as is well-known, has an electrostatic charging unit, a developing unit, and a cleaner in addition to the photosensitive drum 21.

The printer apparatus 1 has a laser exposure unit 22 for exposing the photosensitive drum 21, a transfer unit 23 for transferring a toner image of the photosensitive drum 21 to a sheet (paper) 100, and a heat-fixing unit 24 for fixing the toner image on the sheet. These elements constitute the electro-photographic processing unit.

Below this electro-photographic processing unit is disposed a paper-feeding cassette 10. The paper-feeding cassette 10 stores a large number of sheets of paper 100. A paper-feeding roller 11 picks up paper from the paper-feeding cassette 10. A picked-up paper 100 is run into a resist roller 15.

A manual feeding guide 13 is for manually feeding paper of a size that is not prescribed for the paper cassette, or thick, stiff sheets of paper. A sheet inserted from the manual feeding guide 13 is run into the resist roller 15 by a pick roller 14. In this example, a front-back reversing mechanism 29 for double-sided printing is provided between the paper-feeding cassette 10 and electro-photographic processing unit. The front-back reversing mechanism 29 sends back a sheet conveyed to a discharge opening 18 from the heat-fixing unit 24, guides the sheet to a reversing mechanism using a switching lever 26, and conveys same to the resist roller 15.

Of course, a paper-feeding cassette can be provided at this stage, paper can be picked up by a paper-feeding roller 12, and a picked-up paper 100 can be run into the resist roller 15 without providing a front-back reversing mechanism 29.

A conveying roller 17 conveys a sheet from the heat-fixing unit 24 to a paper-discharging roller 2 of a discharge opening 18, and the paper-discharging roller 2 discharges this sheet to a stacker 19 disposed above the electro-photographic processing unit. A paper guide 27, when open, discharges a thick sheet to the side of the device without guiding same to the discharge opening 18.

A resist sensor 16 is disposed in front of the resist roller 15, and detects the arrival of a sheet at the resist roller 15. A discharge sensor 25 is disposed between the heat-fixing unit 24 and the conveying roller 17, detects the trailing edge of a sheet, and detects the discharge of a sheet from the electro-photographic processing unit. The resist roller 15 makes the leading edge of a sheet even via a picked-up sheet run-in operation, and conveys the sheet in synchronization with the processing speed of the photosensitive drum 21 of the electro-photographic processing unit.

As for the operation of this printer, as is well-known, paper 100 is picked up from the paper-feeding cassette 10 by the paper-feeding roller 11, and run into the resist roller 15. The resist sensor 16 detects this picking operation, and causes a printing operation to start. That is, the laser exposure unit 22 starts to expose an image on the photosensitive drum 21, and, in addition, the conveying of paper 100 by the resist roller 15 commences. A latent image on the photosensitive drum 21 is developed into a toner image by the developing unit, and the transfer unit 23 transfers the toner image of the photosensitive drum 21 to the paper 100 being conveyed. The heat-fixing unit 24 fixes the toner image on the paper 100.

When the discharge sensor 25 detects the trailing edge of the paper 100, the paper-feeding roller 11 picks up the next sheet of paper 100 from the paper-feeding cassette 10. The paper 100 that exited the heat-fixing unit 24 is conveyed to the discharge opening 18 by the conveying roller 17, and is discharged to the stacker 19 by the paper-discharging roller 2. In this manner, paper is printed continuously. For example, 10 to 15 sheets can be printed in 1 minute. This printer 1 stacks the paper-feeding portion, image-forming portion and stacker, enabling a smaller installation footprint.

One characteristic aspect of the present invention lies in the stacker 19 paper-discharging roller 2, and this aspect will be explained below using FIG. 2 through FIG. 6.

FIG. 2 is a top view of the paper-discharging roller 2. As shown in FIG. 2, two paper-discharging rollers 30, 31 are provided. A first paper-discharging roller 30 has a first axis of rotation 32-1, which is supported by a frame 29, and a second paper-discharging roller 31 has a second axis of rotation 32-2, which is supported by the frame 29. Portion B shown in this is one of the characteristics of the present invention. In a conventional printer, the constitution is such that the shaft of the portion B thereof is connected, and is driven in accordance with either a gear or a belt from one side, but in the present invention, as shown in the figure, portion B is not connected, and paper-discharging rollers 30, 31 are operated separately. Furthermore, reference 33 denotes a paper-discharging auxiliary roller, and a guide roller.

FIG. 3 and FIG. 4 are block diagrams of drive mechanisms therefor. FIG. 3 is an embodiment, in which there are provided motors 35, 36, such as independent left and right stepping motors, and each motor 35, 36 separately drives axes of rotation 32-1, 32-2 via speed changing gears 34, 37, respectively. Meanwhile, FIG. 4 is another embodiment, a single motor 38 is provided, and same drives axis of rotation 32-2 of second paper-discharging roller 31 via speed changing gear 37. Motor 38 is connected to speed changing gear 34, and drives axis of rotation 32-1 of first paper-discharging roller 30 via a separate axis of rotation 40. A solenoid 39 is provided in this axis of rotation 40, and connecting gear 34-1 of axis of rotation 40 is separated from speed changing gear 34 by solenoid 39, mechanically stopping the rotation of one of the left or right side of paper-discharging roller 30.

The paper-discharging operation of this constitution will be explained using FIG. 5 and FIG. 6. In the paper-discharging mode, there is a normal paper-discharging mode and an attitude control paper-discharging mode. The normal paper-discharging mode, as shown in FIG. 5, rotates the right and left paper-discharging rollers 30, 31 simultaneously, and paper 100 is stacked straight into stacker 19 the same as in a conventional printer.

Further, the attitude control paper-discharging mode is used, for example, after paper has been stacked as normal, when carrying out printing for a subsequent number of copies, or carrying out printing for a different user. As shown in FIG. 6, the attitude control paper-discharging mode, in a state, wherein one of the left or right paper-discharging rollers 30 is rotating, temporarily stops the rotation of the other paper-discharging roller 31, making roller 31 the pivot point and changing the angle of the medium 100. Thereafter, the paper-discharging operation is performed by once again rotating the stopped roller 31. By intentionally making a medium travel diagonally in the paper-discharging portion, the medium is stacked diagonally in the stacker 19, making it possible to sort same from the previously printed medium.

By repeating this operation, it is possible to sort a number of copies on top of a single stacker 19.

Further, as diagonally stacking means there is also means to discharge the paper by differentiating the speed of the paper-discharging rollers (for example, Japanese Patent Laid-open No. H11-217153), but in this case, the attitude control of the medium 100 becomes difficult according to the thickness, and smoothness of the paper, making it difficult to stack the paper at a fixed angle. For this reason, when an attempt is made to change the angle of a medium 100 by differentiating the speed of the left and right rollers, since there is no pivot point when changing the angle of the medium 100, sufficient nip pressure is required to reliably achieve a fixed angle. However, whereas failure to apply considerable pressure for thick paper causes slippage and makes it impossible to change the angle of the paper, applying pressure to thin paper causes wrinkling.

To reconcile this contradiction, providing a fixed pivot point on the medium 100 and changing the angle of the medium 100 are effective for controlling the angle of the medium 100. That is, by stopping the roller 31 of the one side as in the present invention, because static friction is applied between the roller 31 thereof and the medium 100, friction in excess of that occurs at rotation and is effective for supporting the medium 100.

According to the above-mentioned means, by stopping for a fixed period of time the rotation of one of the left or right side of the paper-discharging rollers 30, 31 of the printer 1, it becomes possible to perform sorting by changing on the stacker 19 the stacked state (direction) of a medium after printing as shown in FIG. 7 through FIG. 9. That is, FIG. 7 shows two-step sorting of ordinary straight stacks 110, 130, 140, and angled stacks 120, 150, and ordinarily this sorting is sufficient.

As another example, FIG. 8 is an example of stacking by changing the angle of the paper in accordance with changing the stopping time of paper-discharging roller 31 in the attitude control paper-discharging mode via either a stepping motor or solenoid control. That is, when paper is stacked straight 110, three-step sorting is possible when paper is stacked at a first angle 120, and when paper is stacked at a second angle 130. In this case, too, unlike stacking diagonally by differentiating the speed of the left and right paper-discharging rollers, sorting can be done via simple control by simply changing the period of time for which the roller of the one side is stopped.

As yet another example, FIG. 9 is such that the paper-discharging angle of the attitude control paper-discharging mode is set at 90 degrees. In accordance therewith, when paper is stacked straight 100, 120, sorting is achieved by stacking the stack 110 that is orthogonal thereto. Doing thusly makes it easy to remove stacked paper, which has been sorted on the stacker 19, enabling enhanced handling.

In this manner, it becomes possible to sort printed matter on a stacker with a single paper-feeding means and a single stacker without providing optional equipment. Further, it becomes possible to easily and stably stack various types of media for which the stacking angle was unstable for a method in which paper is discharged by differentiating the speed of the right and left rollers.

FIG. 10 is a schematic diagram illustrating the required width of a paper discharge opening 18 for the orthogonal stack of FIG. 9. That is, the width of the paper discharge opening 18 is made wider than the diagonal length 13 of a medium 100 that will be the target of attitude control. This is for carrying out attitude control stably such that the angled portion of the medium 100 does not make contact with the edge of the aperture of the paper discharge opening 18 during attitude control of the medium 100.

The diagonal length 13 is obtained by taking the root of the sum of the square of the long side 12 and the square of the short side 11 of a medium 100. For example, when a device, which is capable of controlling the attitude of up to an A4-size medium at the maximum, is given as an example, the dimensions of the A4 medium are a long side 12=297 mm, and a short side 11=210 mm, and thus the diagonal length 13 will constitute 364 mm. Therefore, when paper conveying is skewed 54.7° or more in an A4 longitudinal feeding device, or skewed 35.3° or more in an A4 transverse feeding device, the aperture width of the paper discharge opening 18 must be 364 mm or larger.

This figure must be made 365 mm or larger in the case of an A4 machine (A4 longitudinal feeding device) with an aperture width of 210 mm or more. Conversely, in the case of an A3 machine (A4 transverse feeding-capable device), because the aperture width is 297 mm or more to begin with, the width need only be extended 67 mm, making it more practical. Furthermore, in the case of an A3 extensible machine, because the aperture width is 328 mm or more to begin with, the width need only be extended 36 mm, making it even more practical.

[Sorting Control]

Figure 11:
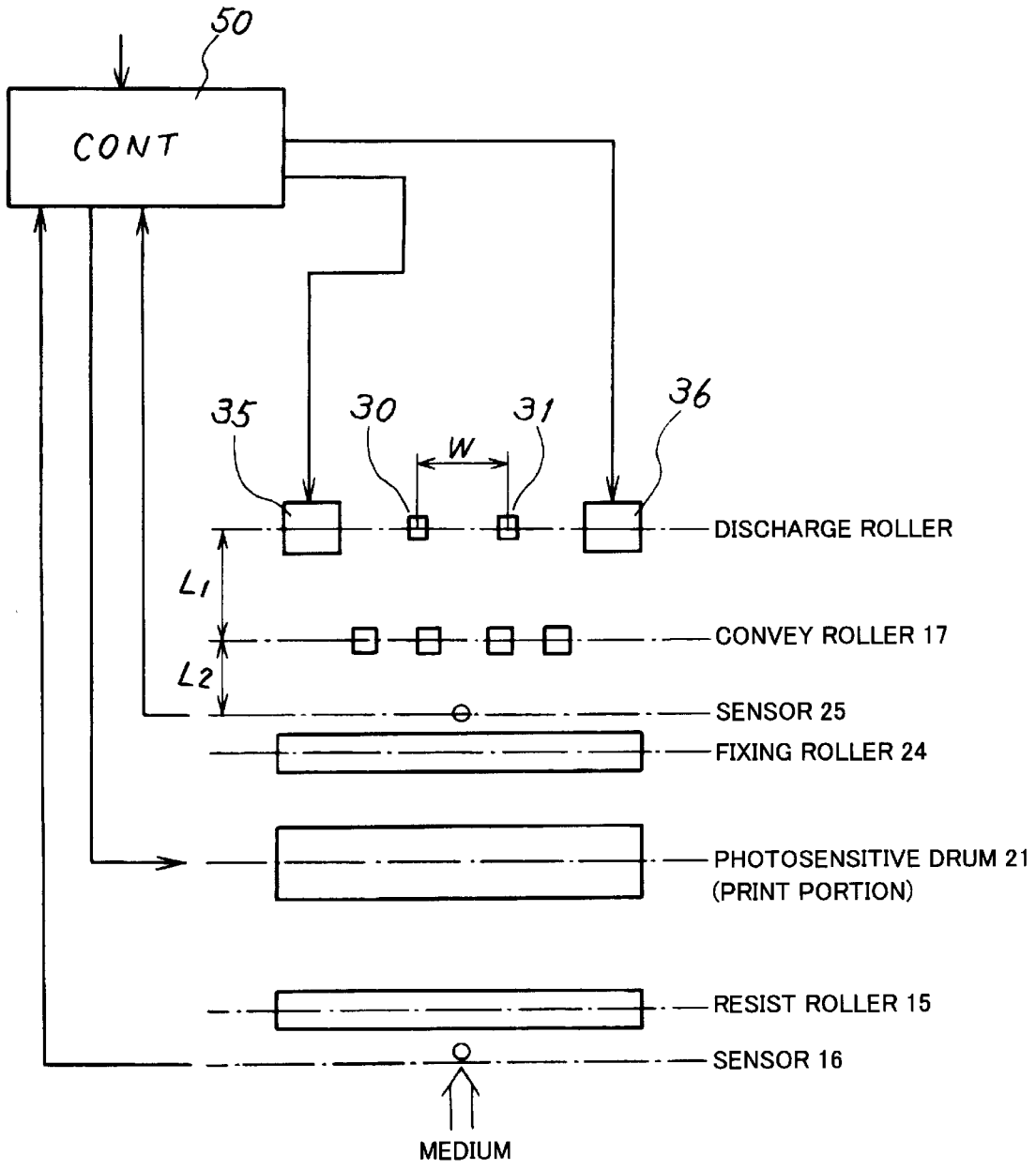
FIG. 11 is a block diagram of the conveyance control system of a first aspect of the embodiment of the present invention.
Figure 12:
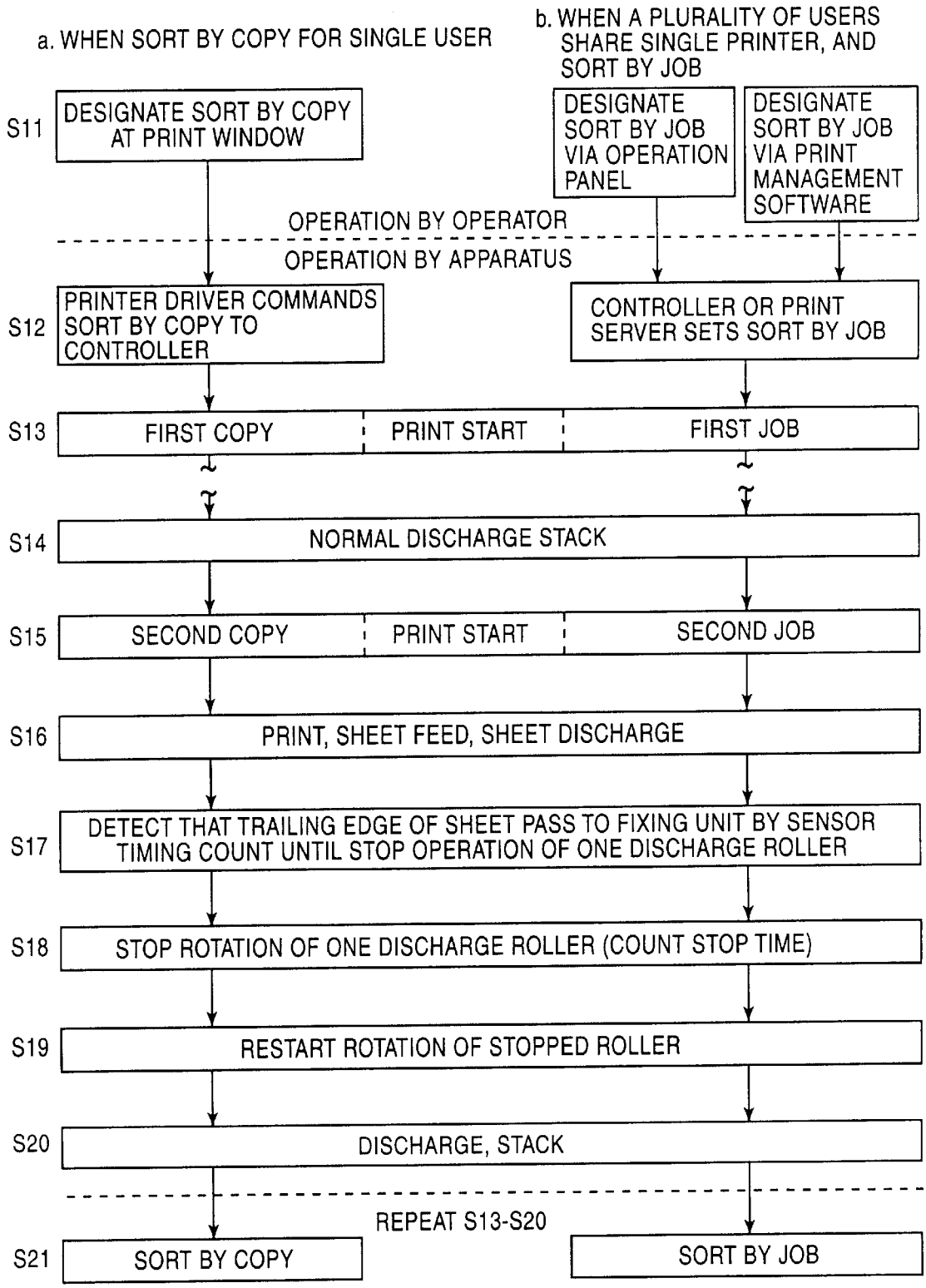
FIG. 12 is a control process flowchart of the controller of FIG. 11.
Figure 13:
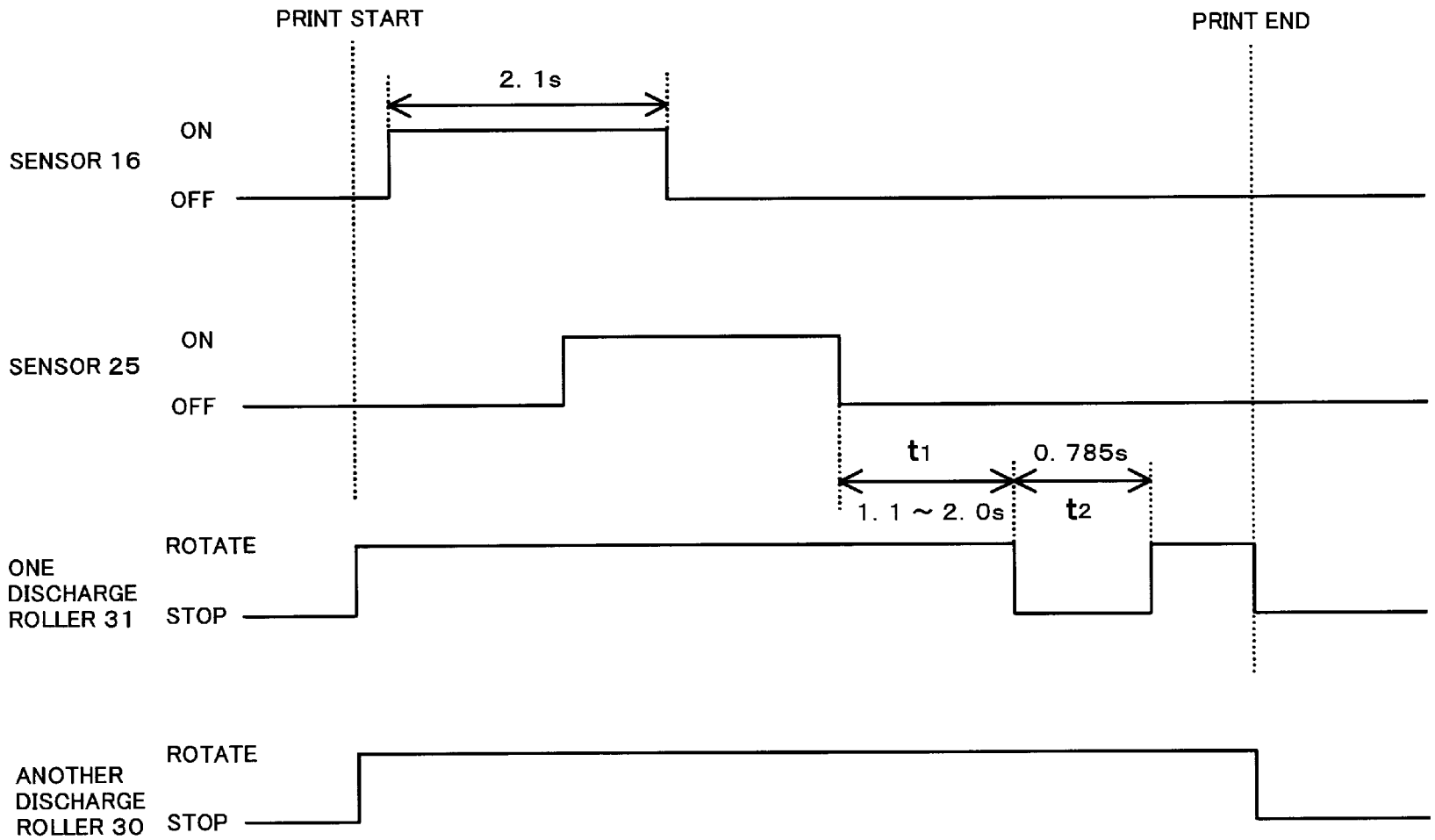
FIG. 13 is a time chart of the attitude control mode of FIG. 12.

Next, control of the paper-discharging mode will be explained in accordance with FIG. 11 through FIG. 13. FIG. 11 is a block diagram of a printer control system, FIG. 12 is a flowchart of the operation thereof, and FIG. 13 is a time chart thereof.

As shown in FIG. 11, when the paper conveying system of a printer 1 is shown in the plan view, this system is constituted from a resist sensor 16, resist roller 15, photosensitive drum 21, heat-fixing roller 24, discharge sensor 25, conveying roller 17, and paper-discharging rollers 30, 31, in that order. A controller 50, which is constituted from a central processing unit (CPU), controls a processing unit, which is represented on the photosensitive drum 21, from the output of sensors 16 and 25, implements printing, and controls the motors 35, 36 of the paper-discharging rollers 30, 31 in accordance with a specified paper discharge mode.

The sorting control flow of FIG. 12 will be explained.

(S11) Firstly, sorting is specified by the operation of an operator. When a single user wishes to sort a plurality of number of copies, sorting is specified for each copy in a PC (personal computer) print window at printing. Further, when a plurality of users are sharing a single printer, and wish to sort by job, sorting is specified by job via either the printer operation panel or the operation of printer management software.

(S12) A command for sorting by copy is issued by a printer driver to the device controller 50. Further, a setting is made in the device controller 50 by either a main unit controller or an attendant printer server so that sorting will be done by job.

(S13) Controller 50 commences the printing operation of either a first copy or a first job.

(S14) Controller 50 implements normal paper-discharging control. That is, controller 50 drives at a constant speed of rotation motors 35, 36, which drive paper-discharging rollers 30, 31, and as seen in FIG. 5, discharges paper 100 straight into the stacker 19.

(S15) Controller 50 commences the printing operation of either a second copy or a second job.

(S16) That is, printing, medium conveying, and paper discharging are started.

(S17) Because the previous time was normal paper-discharging control, this time, controller 50 implements attitude control paper-discharging control. Consequently, as shown in FIG. 13, controller 50 detects from the output of discharge sensor 25 the trailing edge of a medium passing through the heat-fixing portion 24, and counts the timing t1 until the rotation-stop of the paper-discharging roller 31 of the one side. The timing t1 is 1.1 to 2.0 seconds, for example.

(S18) When rotation-stop timing arrives, controller 50 stops paper-discharging roller 31. That is, motor 36 stops. Since the paper-discharging roller 30 of the other side is rotating, in accordance therewith, the paper 100 rotates having paper-discharging roller 31 as a pivot point as shown in FIG. 6. Furthermore, stopping time t2 is counted. Stopping time t2 is set in accordance with the amount of rotation of the paper 100, that is, the angle of skew.

(S19) When the stopping time t2 has elapsed, controller 50 restarts the rotation of the stopped paper-discharging roller 31.

(S20) In accordance therewith, the paper is discharged and stacked in the stacker 19 at an angle.

(S21) Sorting by copy, or sorting by job is completed by repeating this for the required number of copies, or required number of jobs.

For example, this sorting flow will be explained using an example in which an A4 medium (297 mm*210 mm) is conveyed at a speed of 100 mm/s by an A4 machine, wherein FIG. 11 L1=150 mm, L2=100 mm, and W (spacing of paper-discharging rollers 30, 31)=100 mm. When an A4 medium is to be skewed 45 degrees at discharge, following the passage of time within a range of 1.1 to 2.0 seconds after sensor 25 of FIG. 11 turns OFF, the paper-discharging roller 31 of the one side is stopped for 0.785 seconds, and thereafter, operated once again.

After the trailing edge of a medium passes sensor 25, this operation stops the paper-discharging roller 31 of the one side at a place 110 mm to 200 mm forward of sensor 25, makes this the pivot point, continues to feed 78.5 mm of medium via the roller 30 of the other side, rotates paper-discharging roller 31 once again, and discharges the medium. Here, when skewing a medium, 110 mm is the minimum distance that the medium must be conveyed so that the trailing edge of the medium does not strike conveying roller 17. This distance is generally determined from L1, W and the size of the medium.

Similarly, when skewing the medium, 200 mm is the maximum feed rate for ensuring the required range for the paper-discharging roller 30, which does not stop, to nip the medium, and for the paper-discharging roller 30 not to deviate from the medium until the trailing edge of the medium. This distance is generally determined from W and the size of the medium.

Furthermore, the feed rate of 78.5 mm when skewing a medium is the circumference R of radius W at which the paper-discharging roller 31 of the one side is made the pivot point, and is obtained in accordance with the following calculation formula.

$$R = (W * 2) * \pi$$

$$= (10 * 2) * 3.14 = 628 \text{ mm}$$

When determining a 45 degree circular arc from this point, it becomes $$628*(45/360)=78.5 \text{ (mm)}$$

In this manner, it is also possible to easily calculate control values for making the paper-discharging roller of the one side the pivot point, and changing the angle of a medium. When control is performed via the speed ratio of conventional left and right rollers, since a pivot point is not fixed, a plurality of calculations is necessary, and moreover, the effects of the thickness and smoothness of a medium make it difficult to uniformly control the angle of the medium.

Further, by substituting the 45 degrees of the above-mentioned formula with a desired skewing angle, it is possible to calculate the feed rate for a required angle. Converting these distances to time values can be achieved via a value arrived at by simply dividing a distance (feed rate) by the medium conveying speed. For example, in the case of an orthogonal (90 degree) skew, stopping time t2 becomes 1.57 seconds.

[Network Printer]

Next, a network printer, which utilizes this printer 1, will be explained in accordance with FIG. 14 through FIG. 16.

Figure 14:
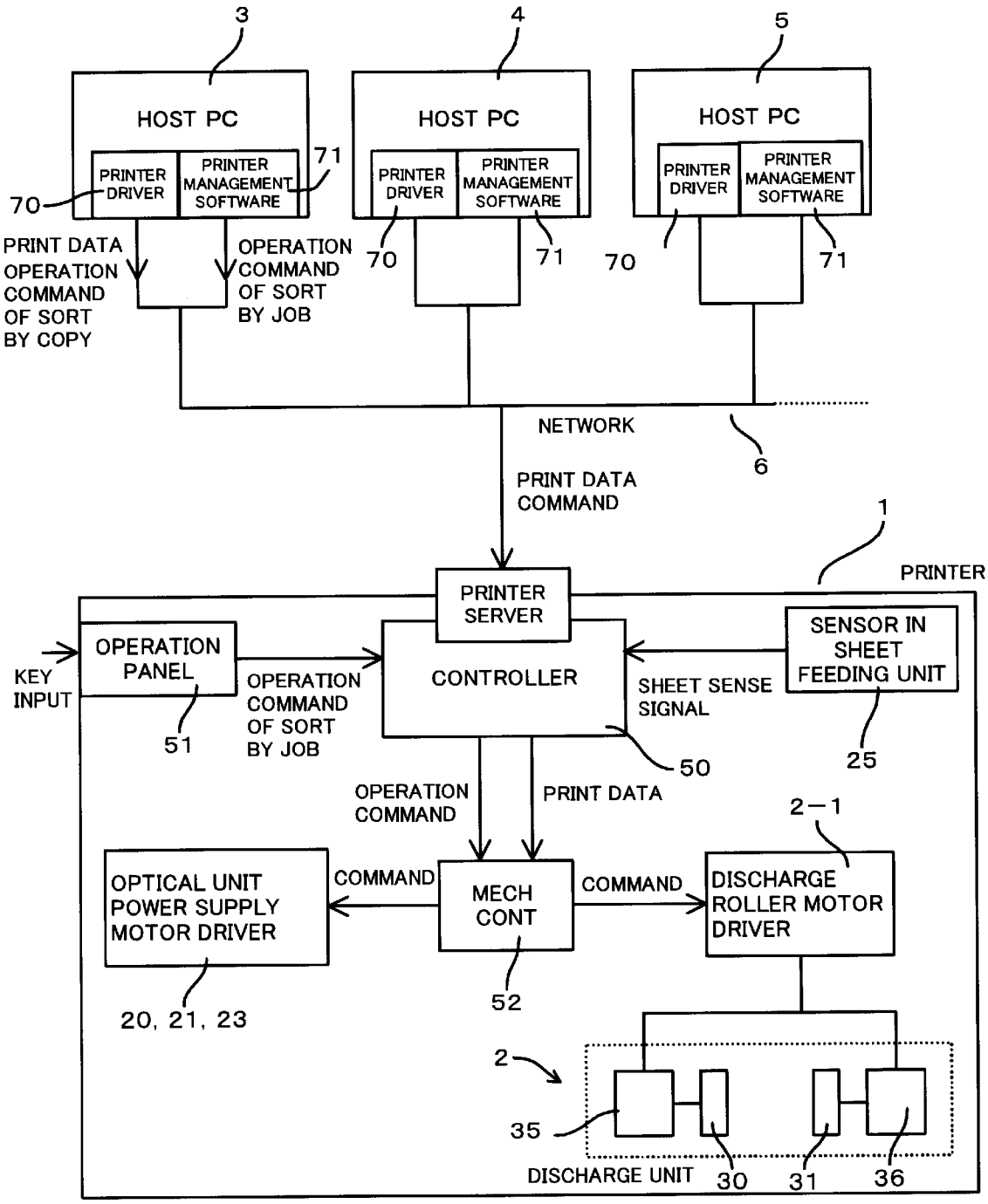
FIG. 14 is a block diagram of a network-type image-forming system of a first aspect of the embodiment of the present invention.
Figure 15:
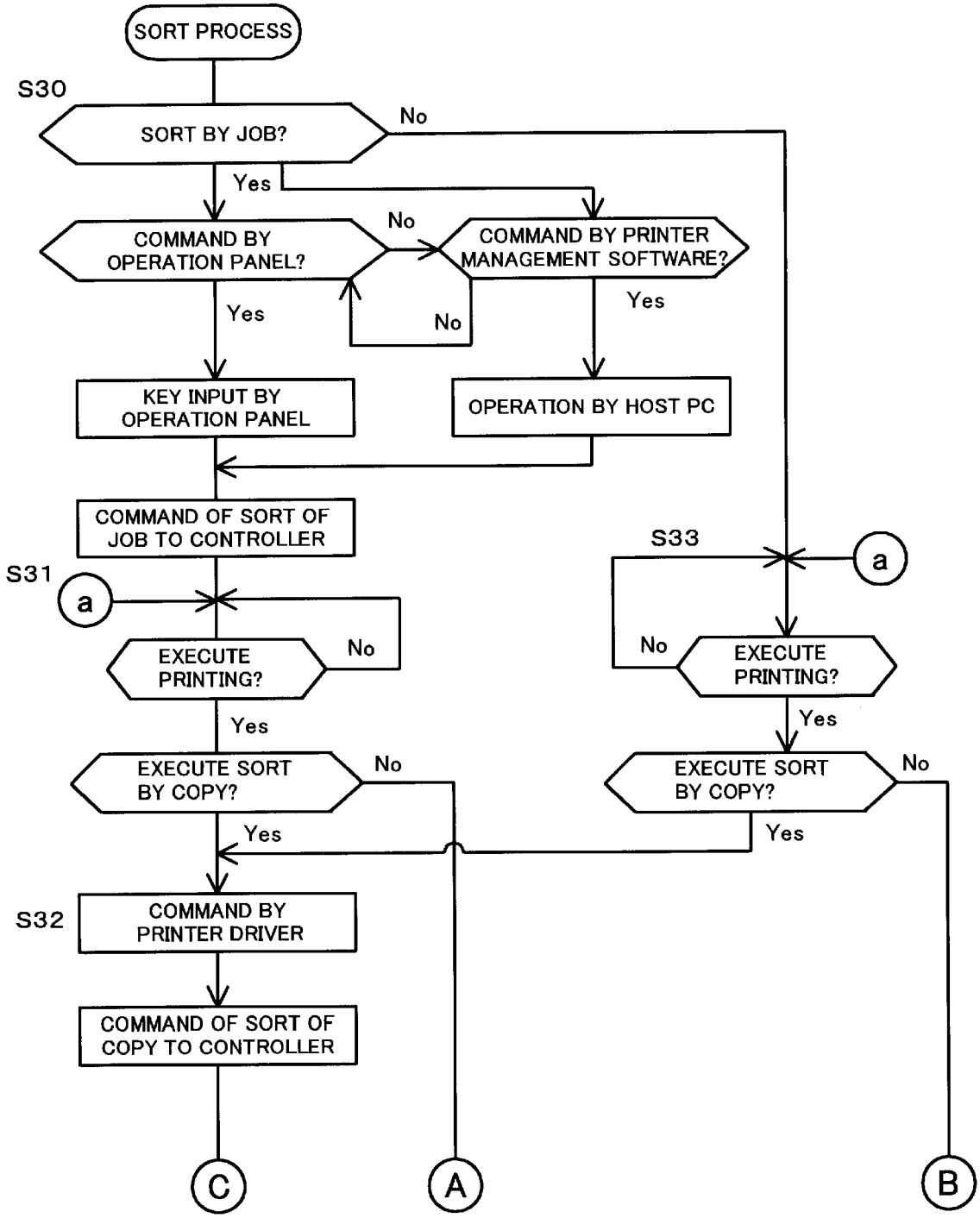
FIG. 15 is a control process flowchart (Part 1) of the controller of FIG. 14.

FIG. 14 is a block diagram of a printer system connected to a network. Printer 1 is connected to a plurality of host PCs 3, 4 and 5 by way of a local area network (LAN) or other network 6. Host PCs 3, 4, 5 can command by-copy operation of printed data via a printer driver 70, and can command by-job operation via printer management software 71. Printer device 1 comprises a printer server 50 as a controller, and can command by-job operation via an operation panel 51. Controller 50 sends printing data and operational commands to a mechanism controller 52, and the mechanism controller 52 controls processing mechanisms 20, 21, 23, and implements paper feeding, printing, and paper discharging. Mechanism controller 52 also separately controls by way of a paper-discharging roller driver 2-1 the motors 35, 36 of the paper-discharging rollers 30, 31 of the paper-discharging portion 2.

The printing process of controller 50 will be explained in accordance with FIG. 15 and FIG. 16.

(S30) When sorting is to be performed by job, by-job sorting is set in the controller 50 via key input from the operation panel 51, or from a host PC via printer management software 71.

(S31) When sorting by job has been set, when printing is to be performed, a command as to whether or not sorting of copy will be performed is issued by the printer driver 70. When sorting is not to be performed, processing proceeds to 'A' of FIG. 16 (S34 of FIG. 16).

Figure 16:
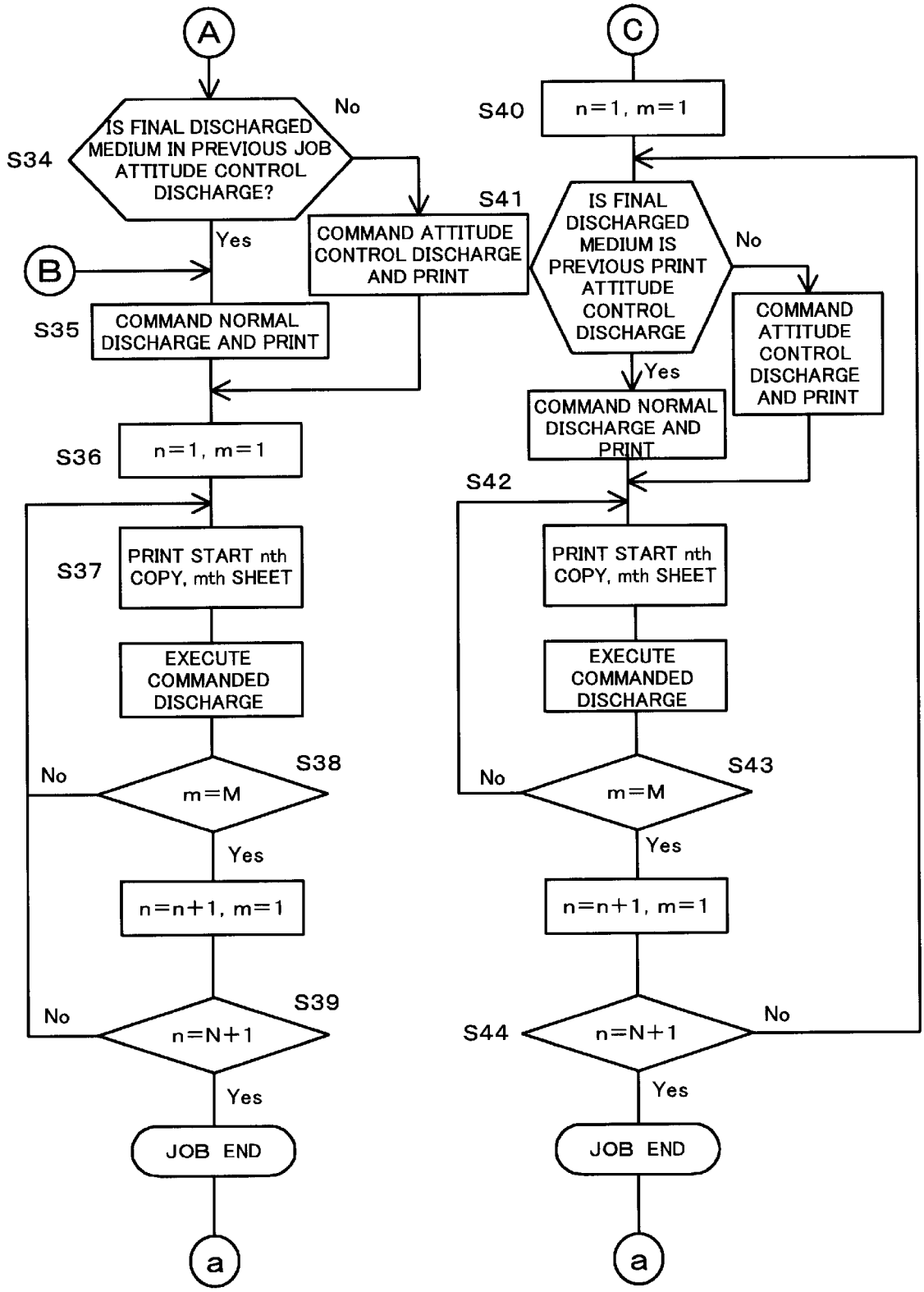
FIG. 16 is a control process flowchart (Part 2) of the controller of FIG. 14.

(S32) To perform sorting by copy, a command to sort by copy is issued to controller 50 from printer driver 70, and processing proceeds to 'C' of FIG. 16 (S40 of FIG. 16).

(S33) When by-job sorting is not set, when printing is to be performed, a command as to whether or not sorting will be performed by copy is issued by the printer driver 70. When sorting is not to be performed, processing proceeds to 'B' of FIG. 16 (S35 of FIG. 16). When sorting is to be performed, processing proceeds to Step S32.

(S34) Controller 50 checks whether or not the final discharged medium of the previous job was an attitude control discharge mode. When it was not an attitude control discharge mode, that is, if it was a normal discharge mode, in order to change the discharge angle from that of the previous job, an attitude control discharge mode command is issued to the mechanism controller 52, and processing proceeds to Step S36.

(S35) Conversely, when controller 50 determines that the final discharged medium of the previous job was an attitude control discharge mode, in order to change the discharge angle from that of the previous job, a normal discharge mode command is issued to the mechanism controller 52, and processing proceeds to Step S36.

(S36) The number of copies pointer 'n', and the number of printed pages within copy 1 (page) pointer 'm' are initialized to "1".

(S37) Controller 50 issues a command to start printing at the mth page of the nth copy. Mechanism controller 52 executes printing, and discharges a medium in the specified medium discharge mode.

(S38) Controller 50 makes a determination as to whether or not m has reached the specified number of pages 'M', and when 'm' has not reached 'M', updates 'm' to "m+1" and returns to Step S37. When 'm' has reached 'M', controller 50 updates 'n' to "n+1" and 'm' to "1" in order to complete the printing of copy 1.

(S39) Controller 50 checks whether or not 'n' has reached "N (specified number of copies)+1". When 'n' has not reached "N+1", returns to Step S37. Conversely, when 'n' has reached "N+1", in order to complete printing of the specified number of copies, the job is terminated, and processing returns to Step S31 of FIG. 15.

(S40) Controller 50 initializes the number of copies pointer 'n', and the number of printed pages within copy 1 (page) pointer 'm' to "1".

(S41) Controller 50 checks whether or not the discharged medium of the printing of the previous copy was the attitude control discharge mode. When it was not the attitude control discharge mode, that is, if it was the normal discharge mode, in order to change the angle of discharge from that of the printed matter of the previous copy, an attitude control discharge mode command is issued to mechanism controller 52, and conversely, when controller 50 determines that the discharged medium of the printing of the previous copy was the attitude control discharge mode, in order to change the angle of discharge from that of the printed matter of the previous copy, a normal discharge mode command is issued to mechanism controller 52, and processing proceeds to Step S42.

(S42) Controller 50 issues a command for printing to start at the mth page of the nth copy. Mechanism controller 52 executes printing, and discharges a medium in the specified medium discharge mode.

(S43) Controller 50 makes a determination as to whether or not 'm' has reached the specified number of pages 'M', and when 'm' has not reached 'M', updates 'm' to "m+1" and returns to Step S42. When 'm' has reached 'M', controller 50 updates 'n' to "n+1" and 'm' to "1" in order to complete the printing of one copy.

(S44) Controller 50 checks whether or not 'n' has reached "N (specified number of copies)+1". When 'n' has not reached "N+1", returns to Step S41. Conversely, when n has reached "N+1", in order to complete printing of the specified number of copies, the job is terminated, and processing returns to either Step S31 or S33 of FIG. 15.

By so doing, it becomes possible to change the discharge angle of discharged printed matter by job, and by number of printed copies, and to perform sorting on a stacker 19. Further, a command can also be issued for sorting not to be performed.

[Other Embodiment]

Figure 17:
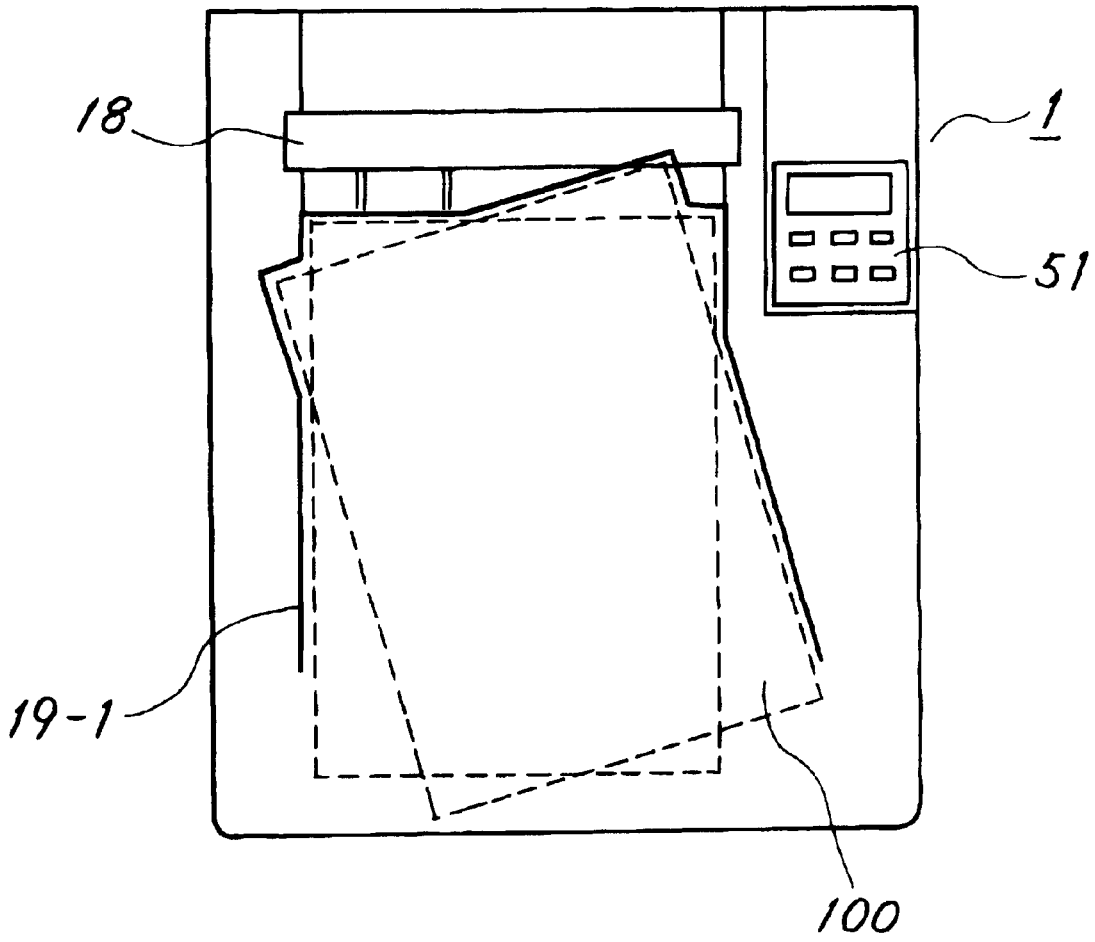
FIG. 17 is a block diagram of a stacker of another aspect of the embodiment of the present invention.

FIG. 17 is a schematic diagram of an example of a stacker shape of another aspect of the embodiment of the present invention. FIG. 17 is a diagram, in which a stacker is viewed from above a printer device 1. As shown in FIG. 17, the shape of the stacker part 19-1 is changed from the normal rectangular shape in order to more reliably stack a medium 100 that has been discharged by changing the angle thereof. A medium 100 is stacked like the dotted line portions in the figure.

Figure 18A:
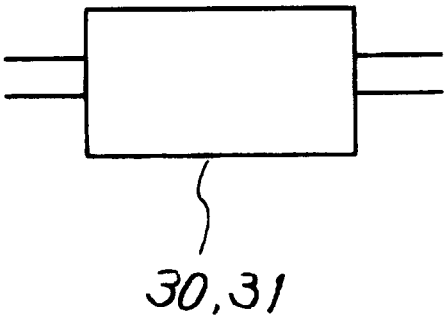
FIGS. 18A and 18B are block diagrams of a paper-discharging roller of another aspect of the embodiment of the present invention.
Figure 18B:
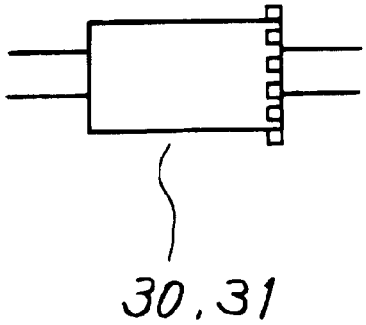

FIG. 18 and FIG. 19 are schematic diagrams of examples of shapes of paper-discharging rollers 30, 31 of another aspect of the embodiment of the present invention. As shown in FIG. 18A and FIG. 18B, it is possible to utilize surface contact-type paper-discharging rollers 30, 31.

Figure 19A:
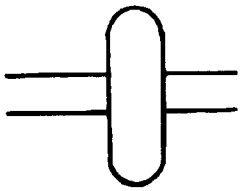
FIGS. 19A, 19B, 19C, 19D, 19E and 19F are block diagrams of a paper-discharging roller of another aspect of the embodiment of the present invention.
Figure 19B:
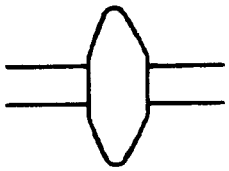
Figure 19C:
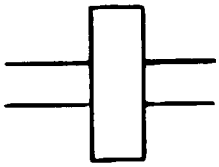
Figure 19D:
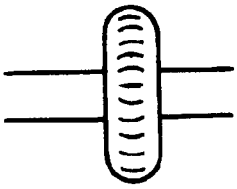
Figure 19E:
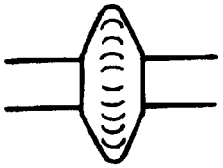
Figure 19F:
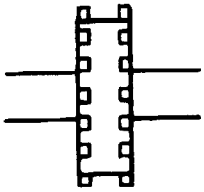

Further, in the present invention, when the roller of the one side is intentionally stopped and the angle of a medium is changed, if the contact width of a paper-discharging roller like those of FIG. 18 and a paper-discharging auxiliary roller relative thereto is wide, there is a danger of wrinkles being generated in the medium when only the roller of the one side is rotated. In a case such as this, when changing the angle of a medium, it is possible to employ a constitution, which prevents the generation of wrinkles and the like by narrowing the width of the medium contact portion of paper-discharging roller 31 that serves as the pivot point. FIG. 19A through FIG. 19C show line contact-type paper-discharging rollers 31, and FIG. 19D through FIG. 19F show point contact-type paper-discharging rollers 31.

Furthermore, an image-forming device, in which paper-discharging roller 31 is stopped and paper-discharging roller 30 can also be stopped, was explained using a printer, but the image-forming device thereof can also be applied to a copying machine or facsimile machine, which performs printing after a document has been read in and stored. Similarly, an image-forming device was explained using an electro-photographic device, but the image-forming device thereof can be applied to another device, which forms an image on a sheet.

Furthermore, sorting in either number of copies units or number of jobs units was explained, but the present invention can also be constituted otherwise, for example, such that a user specifies a desired stack angle, and the specified printed matter stack angle is controlled in accordance therewith. For example, a straight or orthogonal stack can be specified.

The present invention was explained hereinabove in accordance with aspects of the embodiment, but numerous variations are possible within the scope of the gist of the present invention, and these variations are not excluded from the technical scope of the present invention.

Because the present invention is constituted so as to independently drive a plurality of discharging rollers, which discharge a sheet to a stacker, and such that the driving of the plurality of discharging rollers thereof differs for a normal mode and an attitude control mode, it is possible to sort printed matter on top of a stacker with a single paper feeding means and a single stacker without providing optional equipment.

Further, because the driving of the discharging roller of the one side is stopped for a predetermined period of time, and a sheet is rotated using the roller thereof as a pivot point, it becomes possible to perform stacking easily and stably even for multiple types of media for which the stacking angle was unstable with a method, whereby paper discharging is performed by differentiating the speed of the right and left rollers.

What is claimed is:

1. An image-forming apparatus for forming an image on a sheet, comprising:

an image-forming unit for forming an image on said sheet;

a stacker for accommodating said sheet on which said image has been formed;

a discharging unit for discharging said sheet to said stacker and having a plurality of independently driven discharge rollers on separate shafts aligned on same axis rotation and a plurality of auxiliary rollers positioned oppositely to said discharge rollers; and a controller for controlling the driving of said discharging rollers, wherein said controller selectively executes an attitude control mode for stopping the driving of the discharging roller of the one side of said plurality of discharging rollers for a predetermined period of time part way through the discharging of said sheet by said plurality of discharging rollers, and thereafter restarting the driving of said discharging roller of the one side, and a normal mode for driving both sides of said plurality of discharging rollers to discharge said sheet.

2. The image-forming apparatus according to claim 1, wherein said controller, in forming an image on said sheet for a plurality of copies, alternately switches the discharge control of said sheet for each of said number of copies between said attitude control mode and said normal mode for each of said plurality of copies to sort said image-formed printed matter on said stacker.

3. The image-forming apparatus according to claim 1, wherein said controller, in forming an image on said sheet for a plurality of jobs, alternately switches the discharge control of said sheet for each of said jobs between said attitude control mode and said normal mode for each of said jobs to sort said image-formed printed matter on said stacker.

4. The image-forming apparatus according to claim 1, wherein said stacker is constituted in a shape for arranging in order and accommodating of sheets of paper discharged in said normal mode, and sheets of paper discharged in said attitude control mode.

5. An image-forming apparatus for forming an image on a sheet comprising:

an image-forming unit for forming an image on said sheet;

a stacker for accommodating said sheet on which said image has been formed;

a discharging unit for discharging said sheet to said stacker via a plurality of independently driven discharge rollers; and a controller for controlling the driving of said discharging rollers, wherein said controller selectively executes an attitude control mode for stopping the driving of the discharging roller of the one side of said plurality of discharging rollers for a predetermined period of time part way through the discharging of said sheet by said plurality of discharging rollers, and thereafter restarting the driving of said discharging roller of the one side, and a normal mode for driving both sides of said plurality of discharging rollers to discharge said sheet, and wherein said controller sets said predetermined stopping time in accordance with the angle of rotation of said sheet in said stacker.

6. An image-forming apparatus for forming an image on a sheet comprising:

an image-forming unit for forming an image on said sheet;

a stacker for accommodating said sheet on which said image has been formed;

a discharging unit for discharging said sheet to said stacker via a plurality of independently driven discharge rollers; and a controller for controlling the driving of said discharging rollers, wherein said controller selectively executes an attitude control mode for stopping the driving of the discharging roller of the one side of said plurality of discharging rollers for a predetermined period of time part way through the discharging of said sheet by said plurality of discharging rollers, and thereafter restarting the driving of said discharging roller of the one side, and a normal mode for driving both sides of said plurality of discharging rollers to discharge said sheet, and wherein said discharging roller of the one side is constituted of a roller with a relatively narrow with of contact with said sheet, and said discharging roller of the other side is constituted of a roller with a relatively wide width of contact with said sheet.

7. A network-type image-forming apparatus, which is connected to a plurality of hosts via a network, and forms an image on a sheet in accordance with the commands of said hosts, comprising:

an image-forming unit for forming an image on said sheet;

a stacker for accommodating said sheet on which said image has been formed;

a discharging unit for discharging said sheet to said stacker and having a plurality of independently driven discharge rollers on separate shafts aligned on same axis rotation and a plurality of auxiliary rollers positioned oppositely to said discharge rollers; and a controller for controlling the driving of said discharging rollers, wherein said controller, in accordance with the commands of said hosts, selectively executes an attitude control mode for stopping the driving of the discharging roller of the one side of said plurality of discharging rollers for a predetermined period of time part way through the discharging of said sheet by said plurality of discharging rollers, and thereafter restarting the driving of said discharging roller of the one side, and a normal mode for driving both sides of said plurality of discharging rollers to discharge said sheet.

8. The network-type image-forming apparatus according to claim 7, wherein said controller, in forming an image on said sheet for a plurality of copies, alternately switches the discharge control of said sheet for each of said plurality of copies between said attitude control mode and said normal mode for each of said plurality of copies to sort said image-formed printed matter on said stacker.

9. The network-type image-forming apparatus according to claim 7, wherein said controller, in forming an image on said sheet for a plurality of jobs, alternately switches the discharge control of said sheet for each of said jobs between said attitude control mode and said normal mode for each of said jobs to sort said image-formed printed matter on said stacker.

10. An image-forming method for forming an image on a sheet, comprising:

image-forming step for forming an image on said sheet;

discharging step for discharging a sheet, on which an image has been formed by said image-forming unit, to said stacker via a plurality of independently driven discharging rollers on separate shafts aligned on same axis rotation and a plurality of auxiliary rollers positioned oppositely to said discharge rollers; and controlling step for controlling the driving of said discharging rollers, wherein said controlling step selectively executes an attitude control mode for stopping the driving of the discharging roller of the one side of said plurality of discharging rollers for a predetermined period of time part way through the discharging of said sheet by said plurality of discharging rollers, and thereafter restarting the driving of said discharging roller of the one side, and a normal mode for driving both sides of said plurality of discharging rollers to discharge said sheet.

* * * * *